United States Patent [19]

Shiel

[11] 4,328,720

[45] May 11, 1982

[54] SOCKET WRENCH AND SET

[76] Inventor: Walter P. Shiel, 1050 Columbus Ave., San Francisco, Calif. 94133

[21] Appl. No.: 131,193

[22] Filed: Mar. 17, 1980

[51] Int. Cl.[3] ..... B25B 13/00

[52] U.S. Cl. ..... 81/63; 81/121 B; 81/177 G

[58] Field of Search ..... 81/62, 63, 121 B, 121 R, 81/177 R, 177 G, 180 R, 125

[56] References Cited

U.S. PATENT DOCUMENTS

| | | | |
|---|---|---|---|
| 603,377 | 5/1898 | Fitch | 81/63 |
| 613,153 | 10/1898 | Kennelly | 81/121 R |
| 3,253,626 | 5/1966 | Stillwagon et al. | 81/125 |
| 3,299,750 | 1/1967 | Campanile et al. | 81/62 |
| 3,732,756 | 5/1973 | Thomasian | 81/62 |
| 3,881,376 | 5/1975 | Wright | 81/180 R |

FOREIGN PATENT DOCUMENTS

| | | | |
|---|---|---|---|
| 2138245 | 7/1970 | Fed. Rep. of Germany | 81/121 R |

*Primary Examiner*—James L. Jones, Jr.
*Attorney, Agent, or Firm*—Owen, Wickersham & Erickson

[57] ABSTRACT

A socket wrench tool set. A hollow drive ring is retained in an annular head of a socket wrench and is rotatable therein in both directions. The wheel has a ratcheted outer peripheral portion and an interior female drive ring portion with a prismatic driving inner periphery at one end and a circular cylindrical inner periphery at the other end joined by a flat shelf. The cylindrical inner periphery has a diameter greater than that of the largest bolt with which the wrench is to be used. A ratchet pawl is mounted on the handle for engagement with the ratcheted outer peripheral portion. A series of removable sockets is provided; each has at one end a prismatic outer periphery sized for fitting in the drive ring; an inner prismatic periphery at the other end drives a nut or bolt head, and a large circular cylindrical opening, nearly as large as the distance between the opposing walls of that inner prism, extends therethrough to enable passage of a bolt all the way therethrough. Acting as a stop against which the drive end of the socket pushes. A narrow shelf joins the prismatic inner periphery to this cylindrical opening, a socket retainer in the drive ring retains an installed socket in place while enabling its ready purposeful removal.

1 Claim, 9 Drawing Figures

SOCKET WRENCH AND SET

BACKGROUND OF THE INVENTION

This invention relates to improvements in wrenches, sockets, and extender tubes.

The invention provides newly designed sockets of varying size, extender tubes of varying length, and a socketended universal joint, all of which attach to a ratchet wrench to provide a new and unique structure, affording the user all the utility of the currently available socketwrench sets while giving several new advantages.

One of these advantages is accommodation of any length of bolt or other threaded member, so that any nut, within a given range of sizes, can be threaded on its bolt no matter how long the bolt is. Moreover, this is done without using any so-called "deep socket".

Another advantage is the unique adaptability of the device to loosening and tightening spark plugs.

The main thrust in ratchet wrench-socket design has heretofore been directed towards a wrench that is reversible in its direction of rotation, and that has a squared, male drive post, upon which individual sockets are clipped and used. An extender bar or a universal joint may be used between the wrench and the socket to extend the driving action into inaccessible places.

Another current form of design is the closed-end ratchet wrench which is placed directly over the nut or bolt head to be rotated. This design may or may not be reversible. One serious limitation is that the wrench handle must be rotated in the same plane as the nut or bolt. Another limitation is that each wrench can fit only two nut sizes: one on each end of the wrench handle. Therefore, many wrenches must be purchased for a complete assortment of sizes.

The early U.S. Pat. No. 207,117, issued Aug. 20, 1878, described a non-reversible wrench having a removable double-ended socket with a passageway between its ends, enabling passage of the bolt. However, the passageway restricted the size of the bolt that the socket could be used with. Also, when using the smaller socket, the force of the work would tend to force the socket out of the wrench.

U.S. Pat. No. 886,476, issued May 5, 1908, added to a similar ratchet wrench-socket combination a retainer ring to hold the socket in the ratchet wheel, but the through opening was very narrow except for a short wider portion.

U.S. Pat. No. 897,584, issued Sept. 1, 1908, describes a reversible wrench with different sized sockets and extensions; however, each different socket size must be threaded inside the ratchet wheel and is attached to the handle after removing a ring and then replacing it. What appear to be extenders are really only the forerunners of deep sockets, for a different one is needed for each nut size.

In U.S. Pat. No. 3,273,429, issued Sept. 20, 1966, only one socket is provided and it is secured irremovably to the wrench handle. Nor can the socket adapter of the wrench of U.S. Pat. No. 3,967,514, issued July 6, 1976, be changed readily; also in that patent the through opening is necessarily narrow.

SUMMARY OF THE INVENTION

The invention comprises a tool set including a socket wrench with a handle terminating in an annular generally circular head. A hollow one-piece drive ring is retained removably in the head and is rotatable therein in both directions. The drive ring has a ratcheted outer peripheral portion and an interior female socket with a prismatic driving inner periphery at one end and a circular cylindrical inner periphery at the other end joined by a flat shelf acting as a stop for the socket. The cylindrical inner periphery has a diameter greater than that of the largest bolt with which the wrench is to be used. A ratchet pawl is mounted on the handle for engagement with said ratcheted outer peripheral portion of the drive ring.

The tool set includes a series of removable sockets, each having at one end a prismatic outer periphery sized for fitting in the drive ring socket in driving connection therewith. There is an inner prismatic periphery at the other end for driving a nut or bolt head, and the socket has a large circular cylindrical opening nearly as large as the distance between opposing walls of the inner prism, extending therethrough at said one end to enable passage of a bolt all the way therethrough. A narrow shelf joins the prismatic inner periphery to the cylindrical opening, acting as a stop against which the drive end of each socket or other attachment pushes when installed.

Socket retention means in the prismatic periphery of the drive ring portion retain an installed socket in place while enabling its ready, purposeful removal. Each socket has cooperating means for releasably engaging the socket retention means.

DESCRIPTION OF A PREFERRED EMBODIMENT

Figure 2:
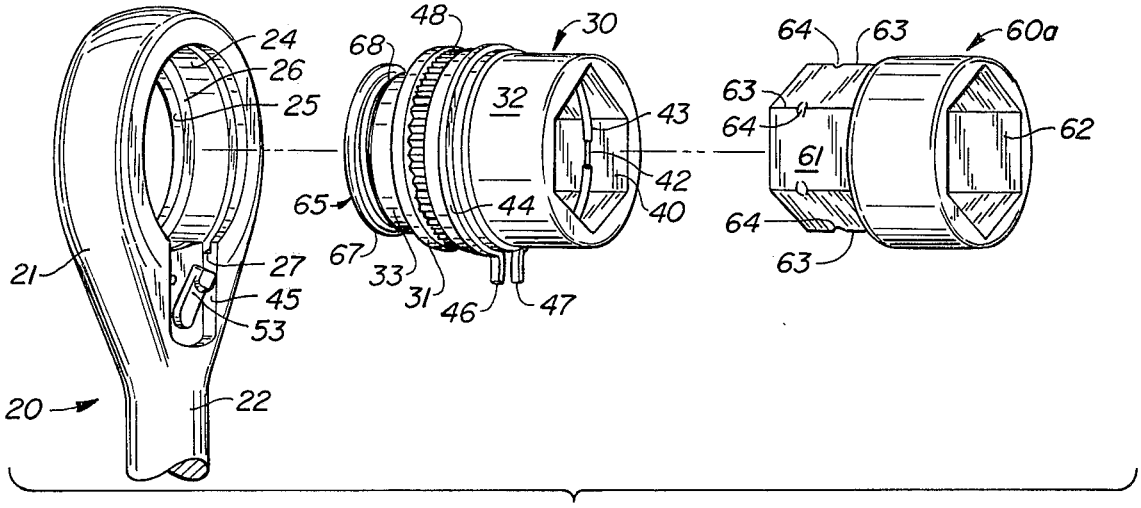
FIG. 2 is an exploded isometric view of the ratchet wrench of FIG. 1 and a socket for use therein, with the handle of the wrench broken off to conserve space.
Figure 1:
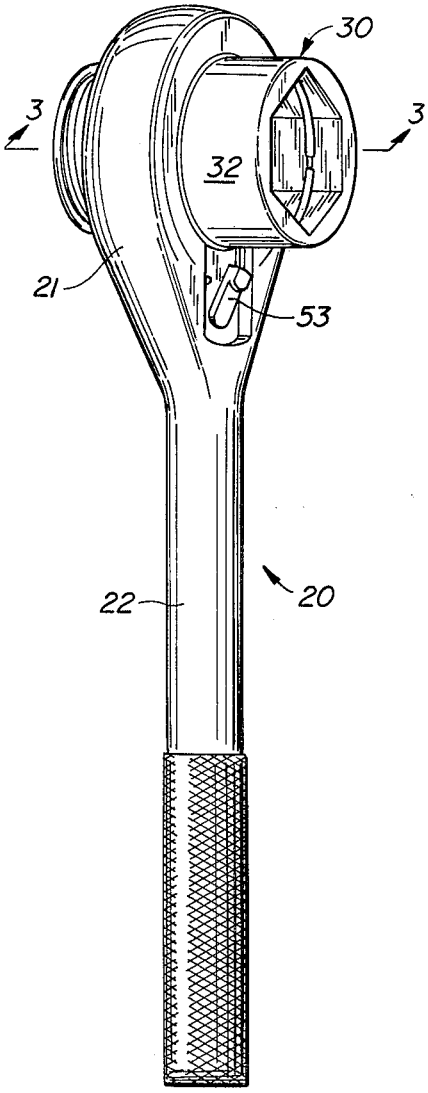
FIG. 1 is an isometric view of a ratchet wrench embodying the principles of the invention.
Figure 3:
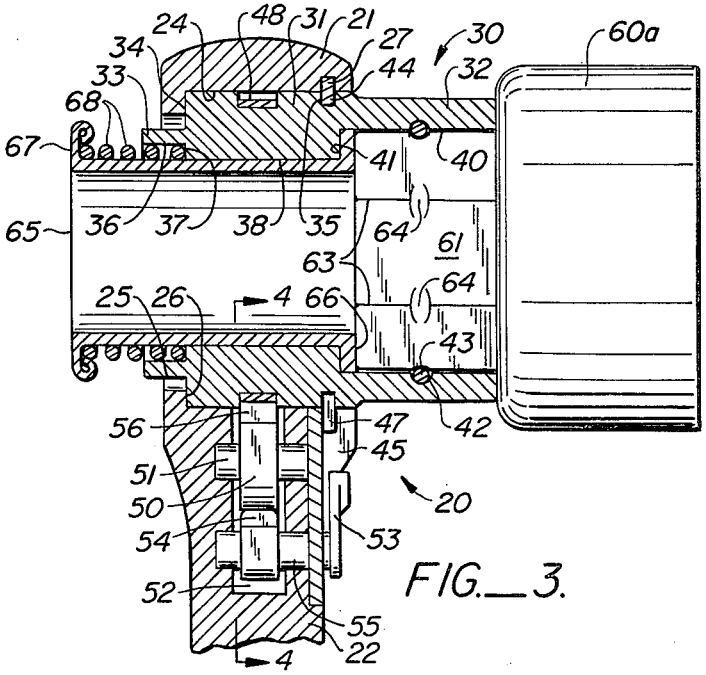
FIG. 3 is a view in section taken along the line 3—3 in FIG. 1, with the handle broken off to conserve space.

A wrench 20 is shown in FIGS. 1–3 and has a wrench head 21 and handle 22. The head 21 may be a generally circular annulus with a large through opening comprising a large cylindrical bore 24 and a smaller cylindrical bore 25 joined by a wall 26 that is perpendicular to both bores 24 and 25 (See FIG. 3). The bore 24 also has an annular recess 27.

The head 21 receives a removable drive ring 30 having a stepped cylindrical outer periphery with a cylindrical portion 31 fitting in the bore 24, a somewhat smaller-diameter portion 32 projecting out therefrom, and a still smaller-diameter cylindrical portion 33 fitting in the opening 25 and joined to the portion 31 by a wall 34 that abuts the wall 26. The portion 31 has an annular recess 35 adapted to face and to be aligned with the annular recess 27. The portion 33 is provided with an axially extending annular end recess 36 having a wall 37 at its inner end. The drive ring 30 also has a cylindrical inner periphery 38 inside the portion 31, while the periphery 32 encloses a polygonal socket 40 joined to the periphery 38 by a wall 41. An annular recess 42 extends around the socket 40 and in it is located a retention spring 43 with the usual discontinuity; the recess 42 is oversize relative to the diameter to the spring wire.

A generally horseshoe-shaped nearly annular spring member 44 fits in and bridges across the annular recesses 27 and 35 and helps to retain the drive ring 30 in place. For this purpose, the wrench 20 has a recess 45 (FIG. 3) in the handle adjacent the retention spring 44 and serves to provide access to the outturned ends 46 and 47 thereof.

Figure 4:
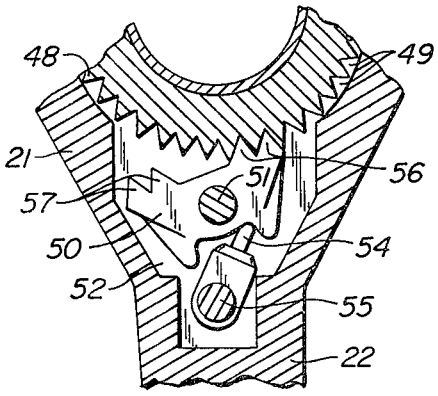
FIG. 4 is a fragmentary view in section taken along the line 4—4 in FIG. 3.

The drive ring 30 has a ratcheted outer peripheral portion 48 which is integral with the remainder of the drive ring 30, being a central portion of the outer peripheral portion 31 and which is provided with teeth 49 of the type that can be used with a bidirectional ratchet. As shown in FIG. 4, the ratchet system may provide a pivotally mounted pawl 50 mounted on a small pivot shaft 51 inside a recess 52 in the place where the handle 22 joins the head 21. Control is obtained by an external latch handle 53 which is joined to an interior lever 54 in the recess 52 and is mounted on a shaft 55, and is used to control the pawl 50, so that it is either in the position shown in FIG. 4 in which its teeth 56 engage some ratchet teeth 49 or rotated to a position where its other teeth 57 engage some teeth 49.

Figure 5:
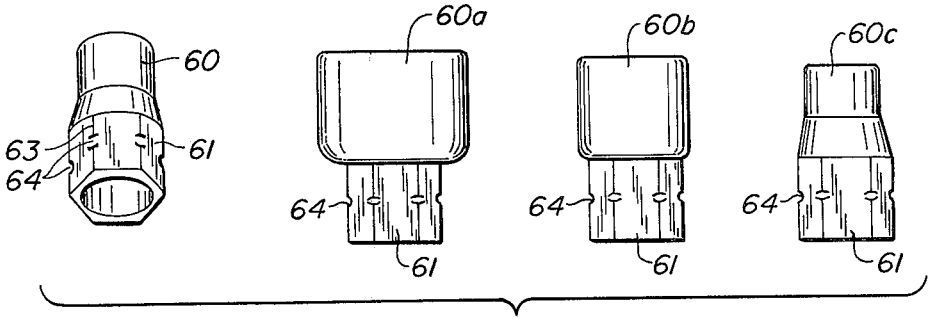
FIG. 5 is a view partly isometric and mostly in elevation of a set of socket wrench inserts.

The socket 40 can receive any of a series of socket members 60, 60*a*, 60*b*, 60*c*, etc., a few of which are shown in FIG. 5. In each instance, these are annular generally cylindrical members each with a drive end 61 having a hollow exteriorly hexagonal outer periphery to fit in the socket 40, and a polygonal socket 62, here shown as hexagonal. They may, of course, be made in twelve-point shape for engaging square nuts. In each instance, the hexagonal outer periphery 61 has its corner edges 63 crossed by recesses 64 adapted to permit engagement by the retention ring 43. The ring 43 may, if desired, be replaced by a spring-loaded ball if the wall of the drive ring 30 is thick enough.

This means that each socket member 60, 60*a*, 60*b*, 60*c*, etc. can, according to a known manner, be simply forced into the drive ring 30 or pulled out. However, assistance may be provided by an ejection member 65, which may be a thinwalled cylindrical annulus with a flange 66 at its inner end and a flange 67 at its outer end. The inner flange 66 abuts the wall 41 and fits withing the bore wall 38. The outer flange 67, which is formed after installation in the drive ring 30, serves to retain a spring 68 that bears against the wall 37. When the outer flange 67 is pushed inwardly, against the pressure of the spring 68, the inner flange 66 transmits the pressure to the socket member 60 and helps to force its recess 64 past the split spring 53 and thus to eject it.

Figure 6:
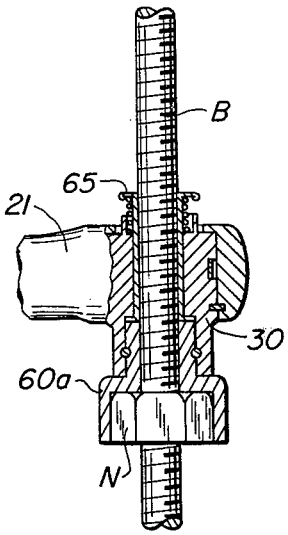
FIG. 6 is a view in elevation and partly in section of the wrench in use to tighten a nut on a long bolt.

The fact that not only the socket members 60, 60*a*, etc. have a wide diameter through opening but that the drive ring 30 also has a wide diameter through opening and that the wrench head 21 is fully open, means that the socket wrench set of the present invention can be used to screw and unscrew nuts or bolts of any length, as shown in FIG. 6. Some old socket wrenches (as mentioned before) had through openings but the sockets were double-ended, so that the wider socket end worked with nuts on bolts that were likely to be too wide to go through the narrow socket end. That is not true here; anytime the nut N fits properly in the socket 60, 60*a*, etc. the bolt B may (if long enough) go through the whole assembly.

Figure 7:
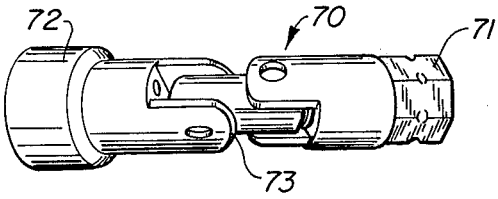
FIG. 7 is a view in elevation of a universal joint fitting for use in the invention.

FIG. 7 shows a universal joint attachment 70 with a drive end 71, a socket portion 72 and connection joint 73.

Figure 8:
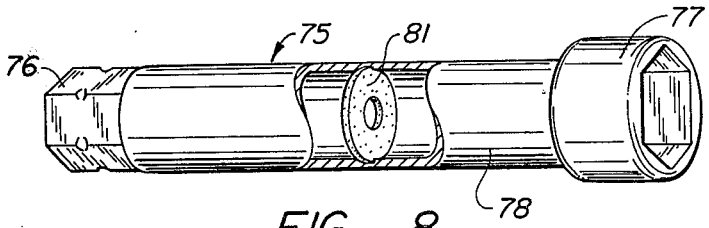
FIG. 8 is an isometric view of an extension member, with a portion broken away and shown in section and also showing a gasket member.

FIG. 8 shows an extender 75 having ends 76 and 77 joined by an extender tube or hollow tubular barrel 78. The end 76 is the same as the end 61 of one of the sockets 60, 60*a*, 60*b*, or 60*c*, and is received into the drive ring 30 just as is a socket 60. The opposite end 76 defines a receptacle identical to that of the drive ring 30, complete with a socket retaining means such as a spring 43, and a narrow shelf as described earlier. When the extender end 76 is inserted into the receptacle 40 of the wrench 20, a socket 60, 60*a*, etc. or other attachment is inserted into the end 77, just as into the receptacle 40, and, therefore, the effect is to extend the receptacle 40 of the wrench and to extend the rotating action to places inaccessible to the wrench 20.

Figure 9:
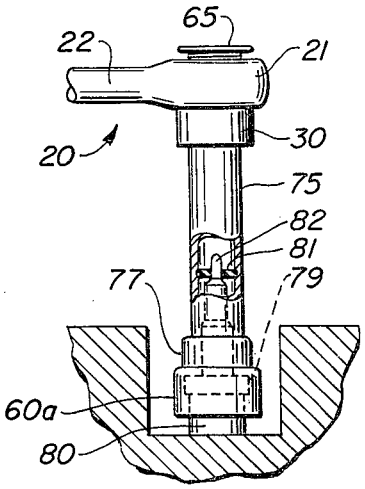
FIG. 9 is a fragmentary view in elevation and partly in section showing the wrench and the extension of FIG. 8 and an appropriately sized socket in use to remove or tighten a spark plug.

One particular use for the extender 75 is to enable easy installation and removal of an automobile spark plug 80, as shown in FIG. 9. Ordinary ratchet wrench sockets are incapable of use with spark plugs because they bottom out before they engage the hexagonal portion 79; hence a special deep socket for spark plugs is required. A special advantage of the present invention is that a regular socket 60*a* fits over a spark plug, so that the wrench 20, extender 75, and appropriately sized socket 60*a*, as shown in FIG. 9 can be used to install or remove spark plugs. To facilitate the operation, a protective insert 81 of rubber or plastic is positioned inside tube 78 through which the upper end of the spark plug extends and is lightly held. The invention has an advantage over the use of a special spark plug attachment because automobile and other engines are currently using a variety of sizes of hexagons on the spark plug, requiring a variety of spark plug attachments, whereas the present invention uses the same wrench 20, the same extender 75, and any suitable socket member 60, 60*a*, etc.

My invention is used basically in the same fashion as are current ratchet wrench-socket combinations. The appropriate socket is attached to the driving mechanism, the correct direction of rotation is selected on the wrench and the work is performed. However, since my wrench has a large female drive ring, instead of a small squared drive post, and receives a large male drive on the socket, it is possible to provide the hole through the entire combination and to eliminate "bottoming out". This occurs frequently in regular socket sets, when, as shown in FIG. 6, the bolt B extends well beyond the position of its nut N, for a distance longer than the length of the socket member 60, etc. "Deep sockets" have been used to solve the problem in some cases, provided that the user has an appropriate one, but deep sockets come in various depths, and are expensive. Some work conditions cannot be accommodated even by deep sockets, such as when extra long bolts used in certain trades (such as in plumbing or electrical installations). Lacking a suitable socket, an ordinary wrench must be used, with all the difficulty that entails. My invention eliminates all these problems by never bottoming.

The size of the hold through the ratchet wrench and attachments is, as described, critical. It must be large enough to admit the bolt of the largest nut size in the socket set. As in current design socket sets, the drive mechanism could be larger or smaller, since the size range of socket sets change.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

I claim:

1. A socket wrench, including in combination a handle terminating in an annular generally circular head, a hollow one-piece drive ring retained in said head and rotatable therein in both directions, said drive ring having a ratcheted outer peripheral portion and an interior female socket having a prismatic driving inner periphery at one end and a circular cylindrical inner periphery at the other end joined by a flat shelf, said cylindrical inner periphery having a diameter greater than that of the largest bolt with which said wrench is to be used, a ratchet pawl mounted on said handle for engagement with said ratcheted outer peripheral portion in each of two positions, one for each direction of rotation, a series of removable sockets, each having at a first end a prismatic outer periphery sized for fitting in said drive ring socket in driving connection therewith, an inner prismatic periphery at a second end for driving a nut or bolt head, a large circular cylindrical opening nearly as large as the distance between opposing walls of said prism, extending therethrough at said first end to enable passage of a bolt all the way therethrough, and a narrow shelf joining said prismatic inner periphery to said cylindrical opening, socket retention means in said prismatic inner periphery of said drive ring portion for retaining an installed socket in place while enabling its ready purposeful removal, each said socket having cooperating means for releasably engaging said socket retention means, and quick release means for releasing said socket from said socket retention means for changing sockets, said quick release means comprising a cylindrical member extending through the cylindrical inner periphery of said drive ring, having a first flange in said socket of said drive ring, against which a said removable socket bears, and a second flange at its opposite end beyond the adjacent face of said drive ring, and a coil spring compressed between said second flange and said drive ring.

* * * * *